United States Patent [19]

Jones

[11] Patent Number: 4,573,384

[45] Date of Patent: Mar. 4, 1986

[54] DICING DEVICE FOR SLICED FOOD ARTICLES

[76] Inventor: Frank W. Jones, P.O. Box 4074, Greenville, Del. 19807

[21] Appl. No.: 636,696

[22] Filed: Aug. 1, 1984

[51] Int. Cl.[4] ..... B26D 3/26

[52] U.S. Cl. ..... 83/404.3; 83/425.3; 83/437; 83/858

[58] Field of Search ..... 83/437, 431, 425.3, 83/404.3, 408, 856–859, 425.2

[56] References Cited

U.S. PATENT DOCUMENTS

| | | | |
|---|---|---|---|
| 2,004,858 | 6/1935 | Farabough | 83/437 X |
| 2,283,029 | 5/1942 | Bakewell | 83/437 |
| 2,407,924 | 9/1946 | Garfunkel | 83/437 |
| 2,497,289 | 2/1950 | Bloomfield | 83/437 |
| 2,572,770 | 10/1951 | Shadduck | 83/437 |
| 2,645,262 | 7/1953 | Marasco | 83/437 |
| 3,112,781 | 12/1963 | Popeil | 83/437 |
| 4,062,260 | 12/1977 | Steinhogl | 83/437 X |
| 4,095,518 | 6/1978 | Jones | 83/437 X |

*Primary Examiner*—James M. Meister
*Attorney, Agent, or Firm*—Charles S. Knothe

[57] ABSTRACT

A sliced food article such as an onion, is quickly diced into a number of rectangular shaped pieces by forcing it through an upper and lower rack of parallel spaced blades such that the upper racks is at right angles to the lower rack forming a rectangular grid. The article, such as an onion, is forced through the rectangular spaces between the two racks of blades by a rectangular array of circular fingers depending from a plunger. The plunger slides along a pair of vertical guides towards and away from the blade. When the plunger is fully engaged with the blades, the free end of the fingers extend completely through the lower rack of blades. The base has four legs to give the device a steady foundation.

7 Claims, 4 Drawing Figures

DICING DEVICE FOR SLICED FOOD ARTICLES

BACKGROUND OF INVENTION

This invention discloses a manually operated device to quickly dice a sliced rounded food article such as an onion. Dicing gives a flavor to foods which is most desirous. Historically institutions and restaurants serving large numbers of people have diced food by hand using an ordinary knife. Dicing by hand with a knife is very time consuming and costly. The procedure used to dice an onion is to first slice it into slices and then to cut each slice with a rectangular grid.

By use of the invention disclosed herein, after the food article to be diced is sliced into slices, with a single stroke the entire food article is uniformly and quickly diced. Thus all of the cutting except for the initial slicing is done with a single stroke. Thus a great amount of time consuming labor is saved which is very important in high volume food preparation establishments.

SUMMARY

Sliced food articles, such as sliced onions are quickly diced by a device comprising a base, a pair of slide guides connected to the base, a rectangular shaped blade assembly with four sides which coordinates with the slide guides and rests on the base. The blade assembly contains an upper rack of parallel spaced tension blades which are fastened to two opposing sides of the blade assembly. The blade assembly also contains a lower rack of parallel spaced tension blades mounted in a plane parallel with the upper rack and rotated ninety degrees such that the upper rack and lower rack form a substantially rectangular grid space between the blades.

The device has a plunger with slide guide ways located at the outer perimeter in which the slide guide ways engage. The plunger transverses towards and away from the base along the slide guide means.

The plunger contains a rectangular array of round fingers depending from it which freely engage within the rectangular spaces formed by the upper and lower racks of blades when the plunger is moved towards the blades. Each finger is a linear element having two ends, one end being attached to the plunger and the other end being free. The fingers are long enough to substanitally pass through the lower rack of blades when the movement of the plunger into engagement with the base is terminated.

DESCRIPTION OF PREFERRED EMBODIMENT

Figure 1:
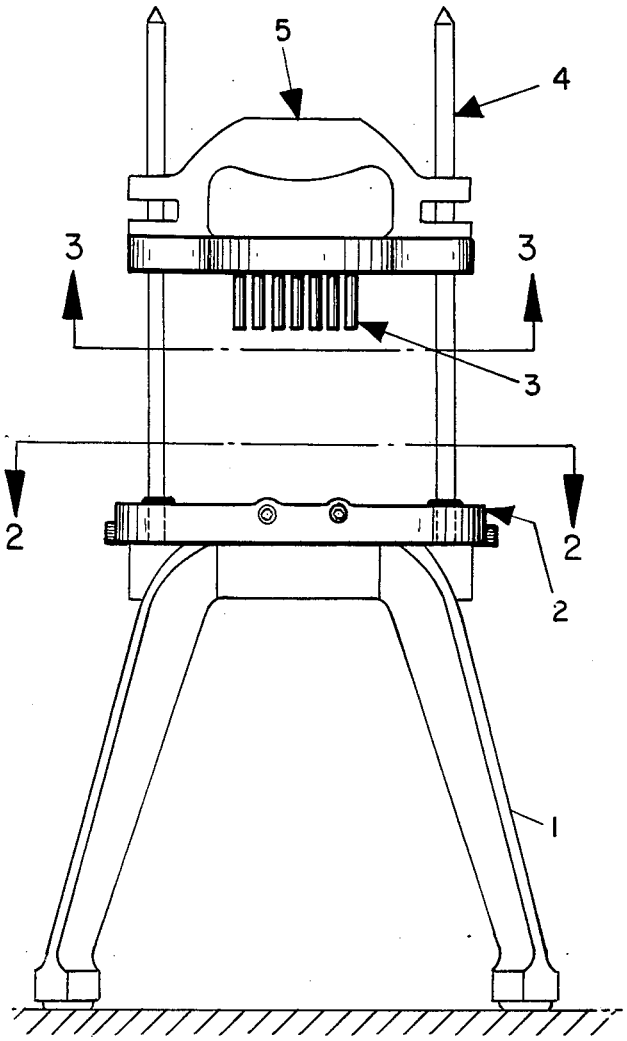
FIG. 1 is a front elevation view of the invention in the open position

FIG. 1 shows the blade assembly 2 mounted to base 1. The blade assembly 2 slides over the guide rods 4 and rests on the base 1. This allows the blade assembly to be removed for cleaning, installing other blade assemblies, i.e., such as sectioning blade assemblies or for replacement when the blades become worn and dull. The plunger 5 slides up and down along slide guides 4. The plunger is removable allowing use of a different plunger necessary for different blade assemblies or for cleaning. FIG. 1 also shows the two ended fingers 3 with one end attached to the plunger and the other end free.

Figure 2:
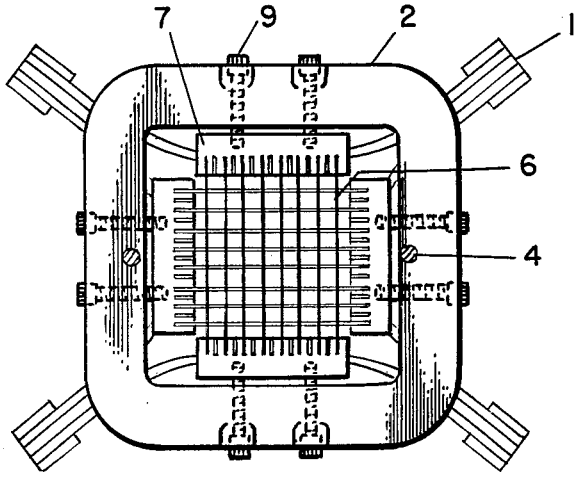
FIG. 2 is a cross-sectional view taken through FIG. 1 along line 2—2.

FIG. 2 shows the blade assembly 2 along line 2—2 of FIG. 1. The blade assembly rests on base 1. The blade assembly consists of two racks of blades, with the blades 6 of one rack of blades perpendicular to the blades 6 of the other rack forming a uniform rectangular grid. Each rack consists of blades 6 and two blade holders 7. Each rack is mounted to the blade assembly 1 by threaded fasteners 9 which hold the rack under tension. FIG. 2 also shows where the slide guides 4 pass through the blade assembly.

Figure 4:
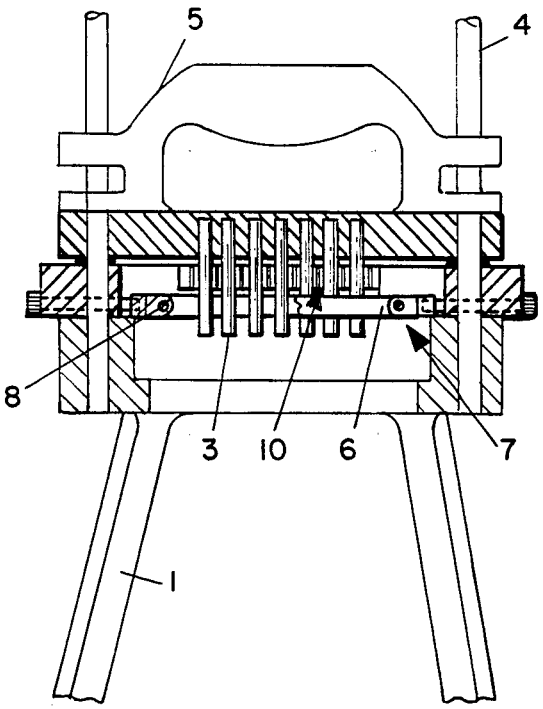
FIG. 4 is a cross section view of the base with the plunger fully engaged with the base.

FIG. 4 shows the plunger 5 fully engaged towards the base 1 with the fingers 3 extending beyond the lower blade 6. This figure also shows the fingers 3 passing in the grid formed by the upper rack of blades 10 and the lower rack of blades 6. The fingers 3 push the food article to be diced past the sharp sides of the blades 10 and 6.

FIG. 4 also shows blade holder 7 containing a hole from one end to the other end along its length. Each blade 6 has a hole at each end as shown in FIG. 4.

Blades 6 are inserted in the grooves in blade holder 7 and pin 8 passes through the hole in the blades and blade holder. A rack of blades consists of a series of blades with a blade holder 7 connected to each end with a pin.

Figure 3:
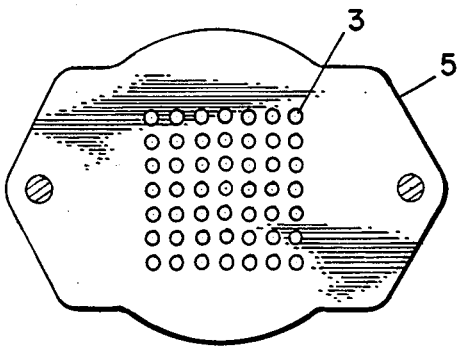
FIG. 3 is a cross-sectional view taken through FIG. 1 along 3—3

FIG. 3 shows the plunger 5 with the free end of the fingers 3 forming a rectangular grid pattern. Each finger 3 passes through the grid formed by the blades 6 in the blade assembly shown in FIG. 2. The fingers 3 are round in cross section to allow for easier manufacturing but could also be rectangular.

I claim:

1. A device for dicing a sliced food article comprising:

a base;

a slide guide means connected to the base;

a removable rectangular shaped blade assembly with four sides, said blade assembly contains slide guide ways in which said slide guide means pass through; said blade assembly rests on said base · an upper rack of parallel spaced tensioned blades mounted within said blade assembly and fastened to two opposing sides of said blade assembly;

a lower rack of parallel spaced tensioned blades mounted within said blade assembly in a plane parallel with the upper rack of blades and rotated ninety degrees such that said upper rack and said lower rack form a substantially rectangular shaped grid;

a plunger having slide guide ways located at the outer perimeter of the plunger in which the slide guides engage, the plunger transversing towards the base and returning along the slide guide means;

a rectangular array of fingers depending from the plunger which freely engage within the rectangular spaces between the upper and lower racks of blades when the plunger is moved towards the blades, the fingers each comprising a linear element having two ends, one end of each finger being attached to the plunger and the other end being free, the fingers being long enough to substantially pass through the lower rack of blades when the movement of the plunger into engagement with the base is terminated.

2. A device as set forth in claim 1 wherein the base has four legs with a range of heights from 7 to 9 inches.

3. A device as set forth in claim 1 wherein the plunger has a handle parallel to the top surface of the plunger and 2 to 3 inches from the surface top of the plunger.

4. A device as set forth in claim 1 wherein the space between the parallel blades in the rack of blades is within the range of $\frac{1}{4}$ to $\frac{1}{2}$ inches.

5. A device as set forth in claim 1 wherein the length of the fingers connected to the plunger are $\frac{1}{2}$ to $1\frac{1}{2}$ inches long.

6. A device as set forth in claim 1 wherein the length of the slide guides is in the range of 10 to 14 inches.

7. A device as set forth in claim 1 wherein the blades have a length of 3 to 5 inches.

* * * * *